United States Patent [19]

Reiter

[11] 4,389,550

[45] Jun. 21, 1983

[54] SWITCH ACTUATING MECHANISM

[76] Inventor: John J. Reiter, 6521 Stevens Ave. S., Minneapolis, Minn. 55423

[21] Appl. No.: 297,877

[22] Filed: Aug. 31, 1981

Related U.S. Application Data

[63] Continuation-in-part of Ser. No. 195,407, Oct. 9, 1980, abandoned.

[51] Int. Cl.[3] ..... H01H 3/16; H01H 3/20; H01H 9/28

[52] U.S. Cl. ..... 200/44; 200/333; 200/334; 200/61.58 R; 200/330

[58] Field of Search ..... 200/44, 333, 50 A, 61.58 R, 200/334, 340, 332, 330

[56] References Cited

U.S. PATENT DOCUMENTS

| | | | |
|---|---|---|---|
| 1,443,867 | 1/1923 | Burns | 200/50 A |
| 2,967,916 | 1/1961 | Williams | 200/44 |
| 3,198,373 | 8/1965 | Ramsing | 200/333 X |
| 3,233,071 | 2/1966 | Bozzell | 200/333 X |
| 3,576,408 | 4/1971 | Meyerhoefer | 200/330 X |
| 3,681,555 | 8/1972 | Ohkita | 200/332 X |
| 4,166,202 | 8/1979 | Reiter | 200/44 |
| 4,206,328 | 6/1980 | Coyle et al. | 200/44 |

FOREIGN PATENT DOCUMENTS

| | | | |
|---|---|---|---|
| 698863 | 10/1940 | Fed. Rep. of Germany | 200/75 |

*Primary Examiner*—James E. Bryant, III
*Assistant Examiner*—Ernest Cusick
*Attorney, Agent, or Firm*—Orrin M. Haugen; Thomas J. Nikolai

[57] ABSTRACT

A safety device for power control in various situations. A housing contains an electrical toggle-type switch which is connected in circuit with the power source and the various elements to be controlled. A depression of a first push-button of relatively small size causes a switch to be turned on, while a subsequent depression of a relatively large surface member pivotally secured to the housing causes the toggle switch to be turned off. A key-operated lock prevents unauthorized operation of the first push-button.

17 Claims, 11 Drawing Figures

SWITCH ACTUATING MECHANISM

CROSS-REFERENCE TO RELATED APPLICATION

This is a Continuation-in-Part of my application Ser. No. 195,407, filed Oct. 9, 1980, entitled "SWITCH ACTUATING MECHANISM", now abandoned.

BACKGROUND OF THE INVENTION

I. Field of the Invention

This invention relates generally to a safety device for power tools and more specifically to a switch actuating mechanism which when appropriately mounted on a power tool stand, allows the operator to turn on the tool's drive motor by a conscious depression of a relatively small sized push button, but permits the motor to be turned off by depression of a relatively broad surface member by a body part other than the hands of the operator whereby there is no need for the operator to take his eyes or hands off of the work and the cutting or abrading tool.

II. Description of the Prior Art

In my earlier U.S. Pat. Nos. 3,312,799 and 4,166,202 there are described various forms of switch actuating mechanisms comprising an "on/off" or momentary type toggle switchs which are adapted to be operatively connected in circuit with an electrical motor for controlling the flow of current thereto. Like the present invention, each of those earlier switch actuating mechanisms included a broad surface member of one type or another pivotally mounted in proximity to the operator's station and this member is mechanically linked to the on/off lever of the toggle switch. Furthermore, in my earlier arrangements described in the aforereferenced patents, a latch and wire bail arrangement is provided which must be appropriately manipulated in a conscious manner before the toggle switch can be moved to its "on" position. As such, the inadvertent turning on of the power to the drive motor is obviated. Once the motor of the tool is turned on, it may be turned off by bumping the broad surface panel member with one or more parts of the operator's anatomy other than his hands and this operation may be accomplished without having to glance away from the working surface of the tool being used. This, of course, leads to greater safety by preventing accidental or inadvertent movement of the workpiece or hands into a position where they may be injured by the tool.

While the earlier arrangements described were altogether satisfactory in their operation, the fabrication of the devices tended to be overly costly to manufacture because of the number of parts involved, making it somewhat difficult to market at a price commensurate with the cost of the tool on which the safety mechanism was adapted to be used.

The instant invention is considered to be an improvement over my two prior inventions. It provides a switch actuating mechanism of the general type described but is designed to be substantially less complicated in terms of the number of parts and their assembly into a completed article. This has been done without compromising the element of safety for which the earlier devices were designed. Furthermore, the present invention incorporates certain of the novel features of my earlier designs resulting in what is considered to be a significant advance in the state-of-the-art.

SUMMARY OF THE INVENTION

In its simplest form, the invention comprises a generally rectangular, box-like enclosure having an electrical switch mounted therein, the switch having an operating lever extending through an aperture formed in the top wall thereof. Pivotally coupled to the front wall of the box-like enclosure at a point proximate the bottom edge of this front panel is a broad surface member in the form of a generally rectangular panel which is held in a first orientation by means of a coil compression spring disposed between the front panel of the box-like housing and the broad surface member. Disposed above the housing is a further box-like enclosure having an aperture formed in an exposed front face thereof. Fitted within this opening is a push button which is mechanically coupled to one end of a lever block or rocker arm pivotally mounted in the second housing. The other end of the lever block is arranged to cooperate with the switch actuating lever on the toggle switch. When the push button is depressed, the lever block is rotated in such a fashion that the toggle switch is turned from an off to an on state. To return the switch to its off condition, the operator need only depress the broad surface member against the force exerted by the coil spring. In doing so, the board cooperates with a plunger positioned in the second housing so as to coact with the operating lever of the toggle switch. Depression of the broad surface member, then, functions to turn off the switch.

A key-operated lock is also mounted in the second enclosure in a fashion which prevents the push button from being depressed when the arrangement is locked.

As will be described in greater detail hereinbelow, the system of the present invention involves a minimum of parts which are designed to mechanically snap together during assembly. Thus, not only is the switch actuating mechanism of the present invention substantially simplified in terms of part numbers but also the parts may be assembled into a finished product with less time involved than is true with respect to the arrangements described in my two earlier patents referenced above.

A special feature of one embodiment of the invention is a construction which facilitates the ready interchange of certain electrical elements, so that the basic unit may be provided with alternative features as desired by the purchaser.

OBJECTS

It is accordingly the principal object of the present invention to provide a new and improved safety device for use in conjunction with electrical motor driven power tools.

Another object of the invention is to provide a switch actuating mechanism for use with electrically powered tools and disposed such that the power may be turned on by the depression of a first push button and turned off through the application of a force against a broad surface member.

Yet another object of the invention is to provide an improved safety device for the control of power driven tools, the safety device including a broad surface member pivotally mounted to a switch box which, in turn, is arranged to be connected at a desired location on a power tool stand whereby the operator's knee, thigh, hip or other part of his anatomy other than his hands may be used to disconnect the power tool from its power supply.

Other and further objects of the present invention will become apparent to those skilled in the art upon a study of the following specification, appended claims and accompanying drawings in which like numerals in the several views refer to corresponding parts.

DESCRIPTION OF THE FIRST PREFERRED EMBODIMENT

Figure 1:
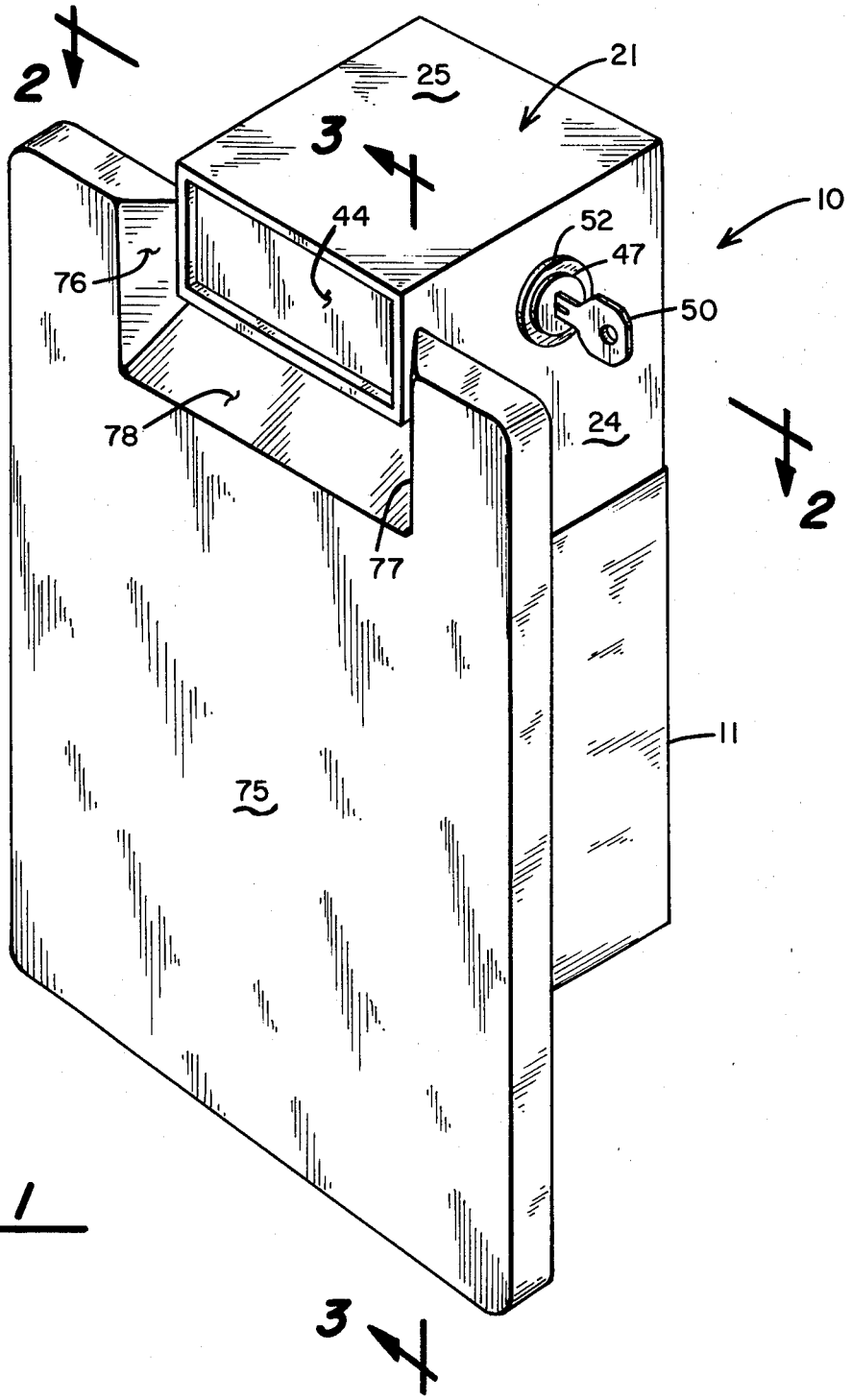
FIG. 1 is a perspective view of a first preferred embodiment of the invention.
Figure 3:
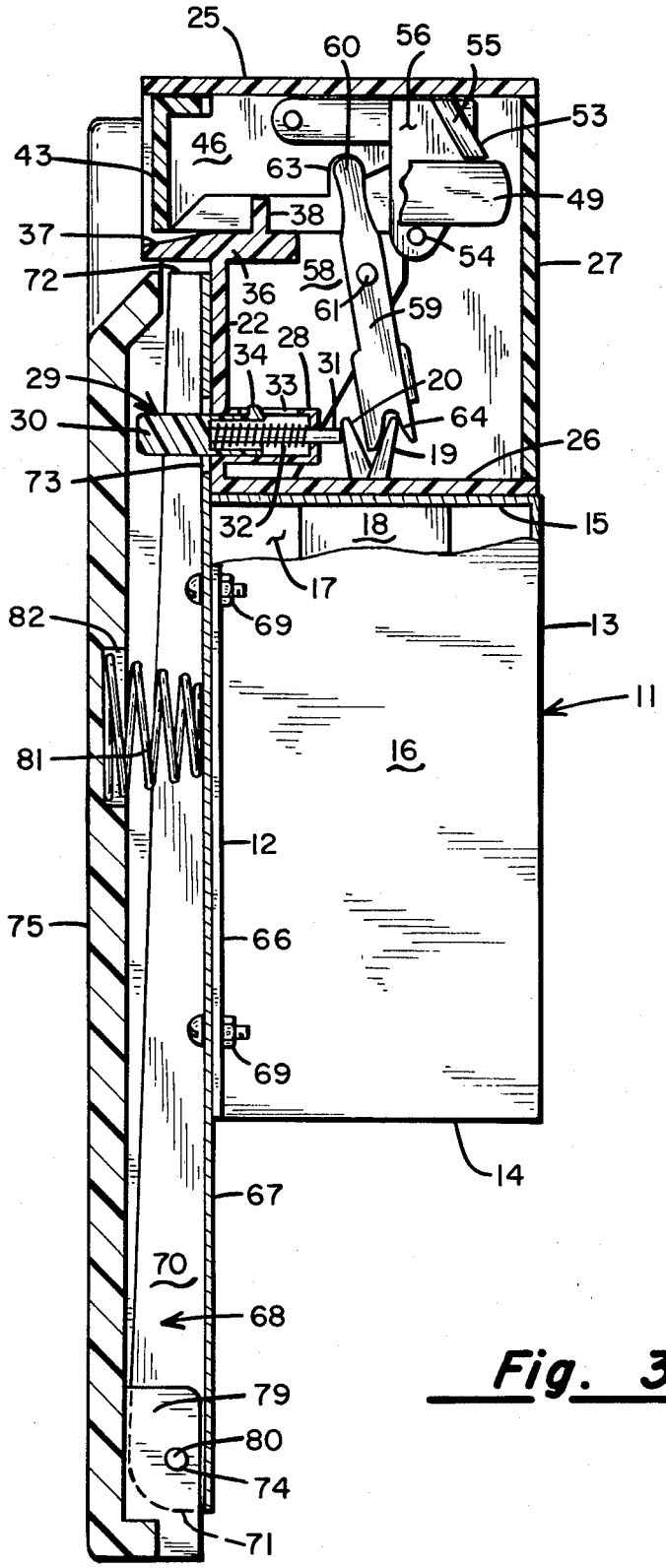
FIG. 3 is a cross-sectional side view taken along the lines 3—3 in the embodiment of FIG. 1.

Referring to FIGS. 1 and 3, a switch actuating mechanism according to the present invention is indicated generally by numeral 10 and is seen to include a first generally rectangular box-like enclosure 11 having a front wall 12, a rear wall 13, a bottom wall 14, an upper or top wall 15 and integrally formed side walls 16 and 17. The bottom wall 14 has one or more apertures (not shown) passing through it allowing electrical wiring to be routed from a source of power into the switch box 11 and out of the switch box 11 to the power tool or device being controlled. In a somewhat similar fashion, an aperture is formed through the top wall 15 of the enclosure 11, allowing a suitable toggle-type switch 18 to be mounted in that aperture with the operating lever or levers thereof extending upwardly through the aperture.

Figure 4:
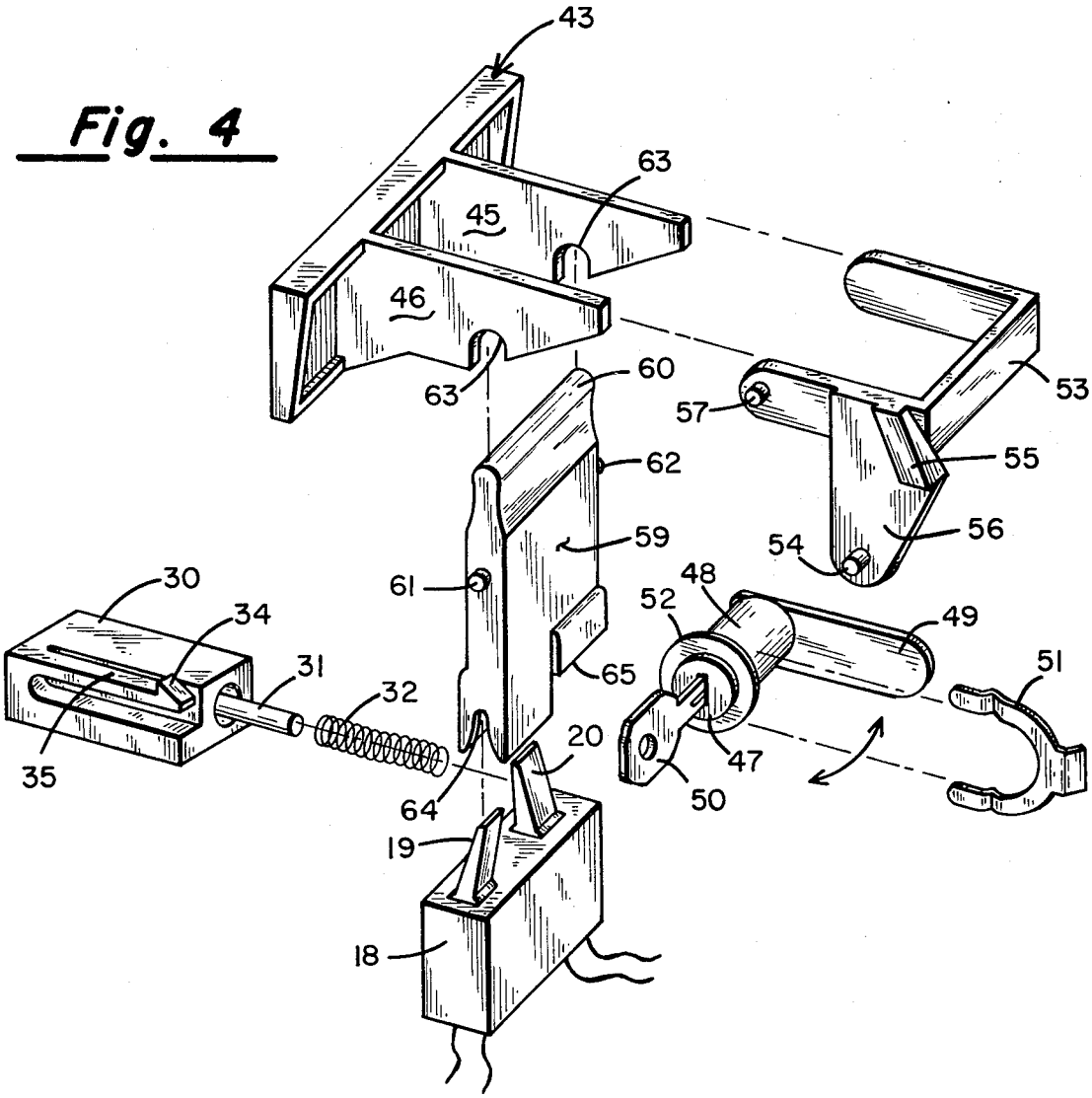
FIG. 4 is an exploded perspective view of the preferred embodiment.

In fabricating the switch actuating mechanism of the present invention, it has been found expedient to use, in certain applications, a simple single pole, single throw on/off toggle switch of a type that is commercially available and which uses a threaded cylindrical stem which is arranged to pass through an aperture in a switch mounting box so as to be held in place by a locking nut screwed onto the threaded stem. As illustrated in FIGS. 3 and 4, an alternative type of switch which may be employed is a momentary switch which operates through a motor control relay (not shown) to selectively energize the motor. The motor control relay generally has a coil and a plurality of normally open and at least one normally closed contact. The coil is arranged to be connected in series with contacts of the switch 18 and between the power terminal such that a momentary closure of the switch by operation of the switch actuating lever 19 will cause the coil to be momentarily energized. This momentary energization, in turn, causes a first set of normally open contacts to close and latch the relay coil in an energized state such that it will continue to be energized even when the switch lever 19 is released so as to return to its original position. Additional control relay contacts close to connect the motor terminals across the power terminals. The switch 18 further includes an additional actuating lever 20 which is also coupled to the motor control relay in such a fashion that operation of the switch lever 20 will break the circuit to the motor control relay coil, causing it to be deenergized and opening the contacts between the motor and its power source. The motor control relay, itself, may conveniently be mounted within the switch box or enclosure 11.

Figure 2:
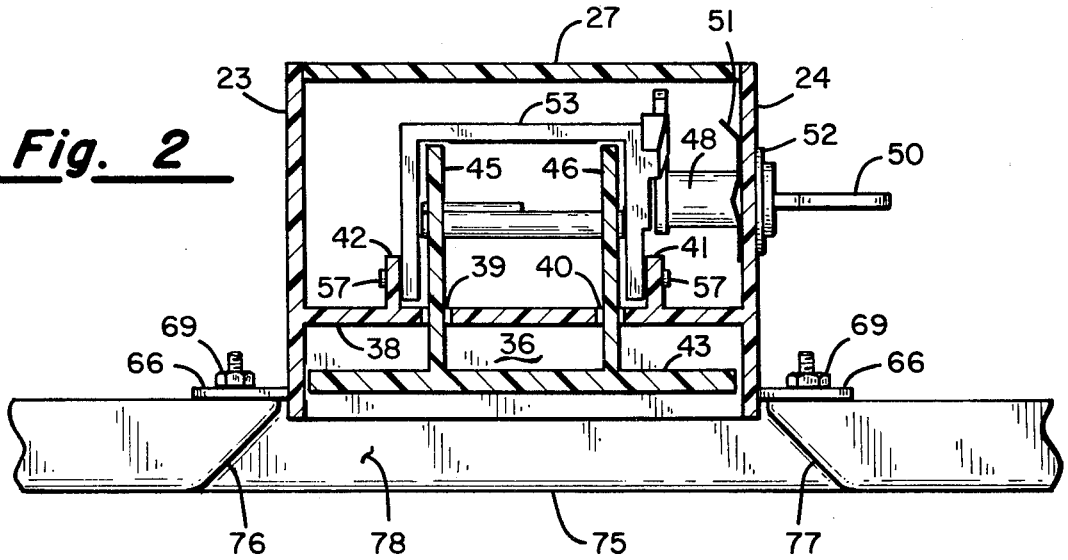
FIG. 2 is a top sectional view taken along the lines 2—2 in the embodiment of FIG. 1.

Disposed atop the enclosure 11 in FIG. 1 is a second generally rectangular box-like enclosure which is indicated generally by numeral 21. As is shown in FIGS. 2 and 3, this second enclosure or housing includes a front face 22 and integrally formed or joined side panels 23 and 24, a top member 25 and a bottom member 26. A rear panel 27, when inserted in place between the top, bottom and sides, completes the upper housing 21.

The lower enclosure or switch box 11 is preferably fabricated from sheet metal, as is conventional for electrical switch boxes, while the upper enclosure 21 may be fabricated from a variety of materials including sheet metal or plastics. The upper enclosure 21 may be attached to the lower enclosure 11 by any suitable means including screws and bolts, clips or bent-up tabs extending from the upper surface of the lower box through mating slots formed in the bottom surface 26 of the upper enclosure. While not shown, it is to be understood that the bottom panel 26 of the upper enclosure has a generally rectangular opening formed therethrough allowing the operating levers 19 and 20 of the switch 18 to project upwardly into the interior of the housing as is best illustrated in FIG. 3.

Referring to the side sectional view of FIG. 3, it can be seen that the front panel member 22 includes an integrally formed tubular projection 28 having a generally rectangular cross-section which extends inwardly and perpendicularly to the plane of the front face 22. This tubular projection is arranged to be in general alignment with the toggle switch lever 20 and fitted within the central opening of the tubular projection is a spring-loaded plunger assembly indicated generally by numeral 29. As is illustrated, the plunger assembly comprises a forwardly extending portion 30 having an axially aligned, rearwardly extending, pinlike member 31 which is arranged to pass through a small hole formed in the end of the tubular projection 28. Surrounding this pin is a compression-type coil spring 32 which serves to normally bias the plunger 30 outwardly from the front face 22 of the upper housing 21. The tubular projection 28 is slotted as at 33 so as to receive a barbed end 34 of an integrally formed flexible finger 35 extending from the plunger member 30. This barbed end 34, when it snaps through the slit 33, serves as a detent to hold the plunger assembly in place.

The front face 22 extends upwardly a predetermined distance and terminates in a horizontal, generally rectangular shelf member 36 which extends across the full width of the upper housing 21. The shelf member 36 has a downwardly and outwardly sloping upper surface as at 37.

With continued reference to FIGS. 2 and 3, it can be seen that a vertically extending wall 38 projects upwardly from the top surface of the shelf member 36, the wall 38 being offset laterally inwardly by a predetermined distance from the front face 22 and having a pair of longitudinal slots 39 and 40 formed through the thickness dimension thereof. The wall 38 extends vertically from the upper surface of the shelf 36 and abuts the top panel 25. Extending rearwardly from the wall 38 are spaced apart ears 41 and 42, these ears being disposed proximate the upper edge of the wall 38 and each having a circular aperture formed through it.

The opening defined by the shelf 36, the top 25 and the left and right sides 23 and 24 allow a generally rectangular push button member 43 to be inserted therein. The push button member 43 comprises a rectangular front surface 44 and extending perpendicularly from its rear surface are parallel, spaced apart ribs 45 and 46. The ribs are of a thickness and are spaced such that they pass through the slots 39 and 40 formed in the wall member 38, these slots acting as guides for reciprocal movement of the push button 43 relative to the wall 38.

To selectively prevent the push button 43 from being moved rearwardly, a locking mechanism is provided which includes a key operated lock 47 which is mounted in the side wall 24 of the housing 21 and which includes a tumbler assembly 48 and a cam arm 49 secured to the end of the tumbler assembly such that it may be rotated when an appropriate key, such as 50, is inserted into the lock and turned. The key operated lock assembly 47 may conveniently be held in place in a circular opening formed in the wall 24 by means of a bifurcated spring clip 51 which fits in a recess (not shown) formed on the periphery of the tumbler assembly 48 so as to hold the flanged portion 52 of the lock assembly tightly against the outer surface of the side wall 24. When so installed the cam arm 49 is arranged to cooperate with a cam follower surface on a locking yoke member 53. Specifically, the cam arm 49 is disposed between a stop projection 54 and a cam follower portion 55 which are formed on a downwardly depending ear portion 56 of the locking yoke 53. The locking yoke is rotatably mounted with respect to the wall 38 in that outwardly projecting pins 57 formed on the opposed arms of the yoke 53, when snapped in position, fit through and rotate within the apertures provided in the projecting ears 41 and 42. As can best be seen in FIG. 2, when the locking yoke is so mounted, and when the locking cam arm 49 is in its locked position, the ends of the ribs 45 and 46 abut the end portion of the locking yoke 53 preventing rearward movement of the push button 43. However, when the cam 49 is moved by the key 50 to its unlocked position, the locking yoke 53 pivots downwardly such that the ends of the ribs 45 and 46 clear the locking yoke 53, permitting a rearward movement of the push button.

Projecting inwardly from the front face 22 are first and second parallel, spaced apart gussets, only one of which can be seen in the side view of FIG. 3. The particular gusset illustrated is the far one of the two as viewed in FIG. 3 and is identified by numeral 58. Formed proximate the upper edge and the innermost end of each of the gussets is a circular aperture, these apertures being in generally horizontal alignment to provide a pivot support for a switch actuating rocker arm member 59. Specifically, the rocker arm 59 comprises a rectangular plate having a generally rounded top as at 60 and aligned circular projections 61 and 62 extending outwardly from the opposed side edges thereof. These projections or pins 61 and 62 are arranged to snap into and mate with the aforementioned apertures formed through the gussets 58. Thus, the rocker arm 59 is free to rotate back and forth about a generally horizontal axis.

With reference to FIGS. 3 and 4, it can be seen that the rib extensions 45 and 46 on the push button 43 have an arcuate recess 63 and the parts are dimensioned such that the rounded upper edge 60 of the rocker arm 59 will be received within the arcuate recess 63 when the pin projections 61 are disposed within the circular apertures formed in the gussets 58.

The lower end edge of the rocker arm 59 is bifurcated as at 64 to form a slot or recess for receiving the switch actuating lever 19 therein. The bottom edge of the rocker arm 59 is also notched as at 65 (FIG. 4), the depth of the notch being sufficient such that the rocker 59 will clear and not interfere with the switch actuating lever 20 during the course of travel of the rocker arm.

The switch box 11 has outwardly extending flanges 66 running substantially the full height dimension thereof, these flanges serving as a means whereby the switch outlet box 11 may be fastened to the base 67 of a generally rectangular channel member indicated generally by numeral 68. Specifically, the outlet box 11 may conveniently be bolted to the base 67 of the channel 68 by means of bolts as at 69 passing through the base and the flanges. Because of the manner in which the view of FIG. 3 is cross-sectioned, only the far side wall 70 of the channel can be seen. It is to be understood, however, that the channel 68 includes a near side wall of the same shape profile as the side wall 70. That is to say, the side wall 70 is of a predetermined width proximate the lower edge 71 thereof which is greater than the width at the top 72 thereof. The side walls continuously taper from bottom to top as illustrated.

An opening is formed through the base 67 of the channel 68 as at 73 and it is of a size to allow the plunger 29 to extend through it with sufficient clearance to permit free reciprocal movement. Both the near and far side walls of the channel 68 are provided with a small aperture as at 74, these apertures being aligned across the width dimension of the channel 68.

Completing the assembly is a broad surface member 75 which, as indicated in FIG. 1, is generally rectangular and which has a rectangular notch or opening formed proximate the upper edge thereof, the opening being defined by inwardly sloping side edges 76 and 77 and an upwardly and inwardly sloping bottom edge 78, the opening in the broad surface member 75 surrounding the opening formed in the front face of the upper enclosure 21 along three edges. Hence, the push button 44 is accessible through the recess formed in the broad surface member 75.

The broad surface member or panel 75 is pivotally secured to the side walls of the channel 68. Specifically, integrally formed with the rear surface of the broad surface member is an extension 79 which projects outwardly and which has an aperture which is in alignment with the aperture 74 formed through the side walls of the channel. Thus, a pin 80 may be snapped into the extension 79 and through the sides of the channel so that the broad surface member 75 may pivot about the pin 80. A coil spring 81 is disposed between the base 67 of the channel 68 and the broad surface member so as to normally urge these two elements apart. It may by convenient to form a generally circular recess as at 82 in the rear surface of the broad surface member 75 to hold the coil spring 81 in place.

Now that the details of the construction of the first embodiment have been set forth, consideration will be given to its mode of operation.

OPERATION OF THE FIRST EMBODIMENT

As has already been mentioned, the present invention comprises a safety device in the form of a switch actuating mechanism for facilitating the control of drive motors or the like commonly used with power tools. For example, the present invention may be used with a wide variety of power tools including table saws, drill presses, lathes, sanders, joiner/planers and the like. The device is mounted at a convenient location proximate the operator's usual work station and power is brought into the outlet box 11 by way of wires (not shown) which lead to the switch 18 or to a motor control relay (not shown) which may be housed within the outlet box 11. Similarly, the conductors leading to the drive motor for the power tool are brought in through an aperture in the bottom 14 of the outlet box 11 and are wired in a conventional fashion to the switch 18 or to the aforementioned motor control relay.

To start the motor, the operator must first unlock the device by rotating the key 50 such that the cam 49 turns in a clockwise direction as viewed in FIG. 3 to push against the pin projection 54 and cause the locking yoke 53 to also rotate in a clockwise direction. The stop bar portion of the yoke 53 thus drops out of the path of the ends of the ribs 45 and 46 on the push button 43. The operator may now depress the push button 43 and it moves rearward guided by the slots 39 and 40 formed in the wall member 38.

In that the rocker arm 59 is pivotally supported between the parallel, spaced apart gussets 58 by virtue of the pin 61 passing through holes formed in these gussets and because the upper rounded end 60 resides in the arcuate recess 63 formed in the bottom edges of the ribs 45 and 46, the movement of the push button in a rearward direction causes a clockwise rotation of the rocker arm 59 as viewed in FIG. 3. Because the switch lever 19 is entrained within the bifurcated recess or notch 64 formed in the bottom of the rocker arm 59, this clockwise rotation of the rocker arm causes the switch lever 19 to move momentarily to its ON position. When this happens, a circuit is completed to the motor control relay causing the relay to latch up and maintain a closed circuit between the power supply and the motor being controlled. The operator may remove his finger from the push button 43 and, in doing so, the internal spring of the momentary switch 18 will cause the switch lever 19 to rotate clockwise and will impart a counterclockwise rotation to the rocker arm 59. This counterclockwise rotation of the rocker arm will force the push button 43 back to its starting position.

All the while, the machine will be running in that the momentary closure of the switch 18 effected an energization of the motor control relay and its latching contacts. When the operator desires to again turn off the motor, he may apply a force either with his hand, but preferably with another part of his anatomy such as his thigh, knee or hip, against the broad surface member 75 to thereby overcome the force of the coil spring 81 and force the member 75 against the plunger 30. Depression of the broad surface member 75 against the force of the spring 81 then causes the plunger to move to the right viewed in FIG. 3 such that the pin 31 abuts the switch lever 20 forcing it in a rearward direction. During its travel, the electrical connection to the motor control relay coil is momentarily broken, causing the latching contacts to release and disconnecting the motor from the power supply. When the broad surface member 75 is released, the coil spring 81 returns it to its vertical orientation while the coil spring 32 associated with the plunger 29 ensures that it will also be returned to its at-rest position with the switch lever in its forward orientation.

To lock the switch actuating mechanism and to thereby prevent unauthorized use of the power tool, the operator turns the key 50 causing the switch arm 49 to move upward against the cam surface 55 and lifting the locking yoke 53 to a position wherein it is in the path of the ends of the ribs 45 and 46 on the push button 43 and blocks any rearward travel thereof. Thus, the rocker arm 59 cannot be rotated, which prevents the switch lever 19 from being moved to its momentary ON position.

When instead of utilizing a momentary on/off motor control switch in combination with a motor control relay device, it is desired to use a simple single pole, single throw toggle-type switch, only a minor modification need be made to the illustrated embodiment. The simple toggle-type switch, of course, has only a single operating lever. This lever would be positioned within the bifurcated notch 65 of the rocker arm 59, predetermined to do so by design; thus, pin 31 of the plunger assembly 29 is in horizontal alignment with that switch lever. Hence, depression of the push button 43 would cause the switch lever to move from an off orientation to its on orientation and a subsequent depression of the broad surface member 75 would cause the plunger 30 to force the pin 31 against that on/off switch lever, moving it to its off position.

By making the ON push button 43 relatively small and by recessing it within the opening defined by the shelf 37, the side walls 23 and 24 and the top 25, accidental operation of the on switch is practically eliminated. Once the push button switch 43 is operated to turn the machine on, the operator need not search around for an OFF switch in that application of a force almost anywhere on the broad surface member 75 functions to turn off the machine.

While the locking arrangement for preventing depression of the "ON" push button is an effective way of precluding unauthorized use of the machine with which the subject invention is being used, it is also possible to prevent unauthorized use by utilizing a key-operated electrical switch which would be mounted on the switch box 11. When a proper key is inserted in the tumbler and rotated, the switch is operative to apply electrical current to the utilization device via the toggle switch 18. However, when the key-operated electrical switch is off, the circuit is broken to the toggle switch 18 and closure thereof is incapable of initiating operation of the motor or other device with which the switch actuating mechanism of the present invention is used.

DESCRIPTION OF THE SECOND PREFERRED EMBODIMENT

Figure 5:
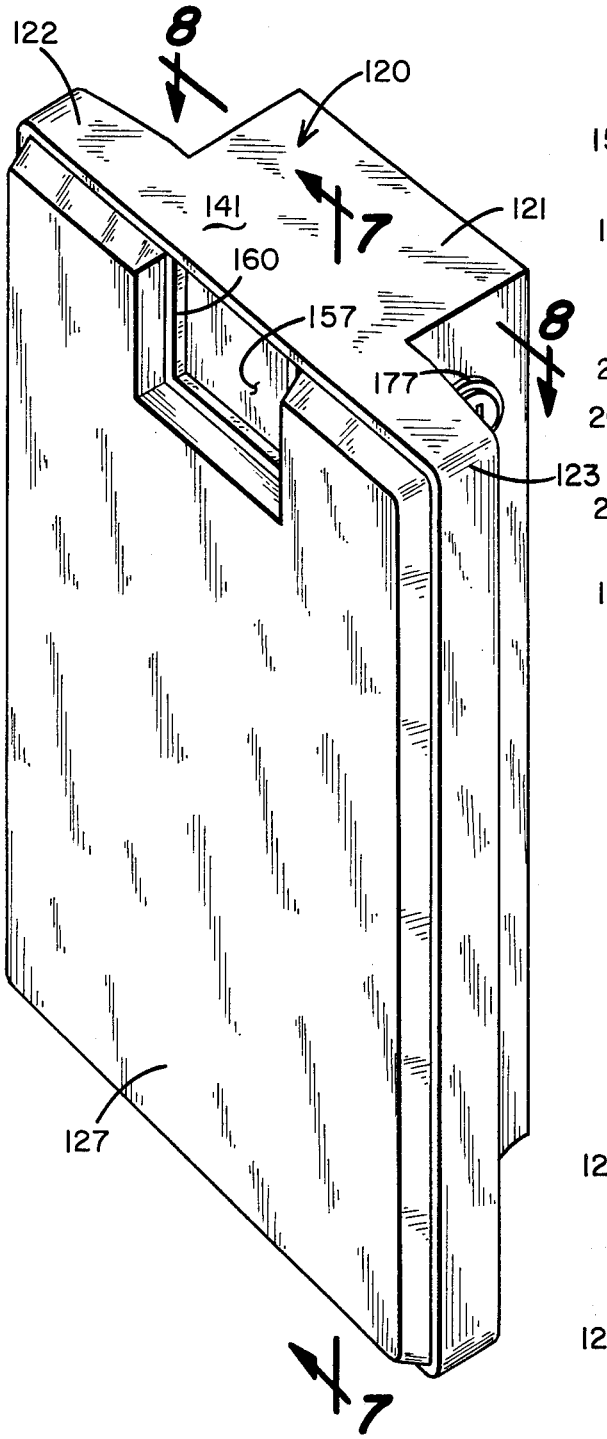
FIG. 5 is a perspective view of a second embodiment of the inventions.

A second embodiment of a switch actuating mechanism according to the invention comprises, as shown in FIG. 5, a housing 120 having a deeper central trough 121 and shallower lateral trays 122, 123 formed integrally therewith. The continuity of sides 122, 123 with the top extension shown at 141 and its bottom counterpart shown at 139 in FIG. 7 form a protective shroud around the insertable actuating panel member 127.

Figure 7:
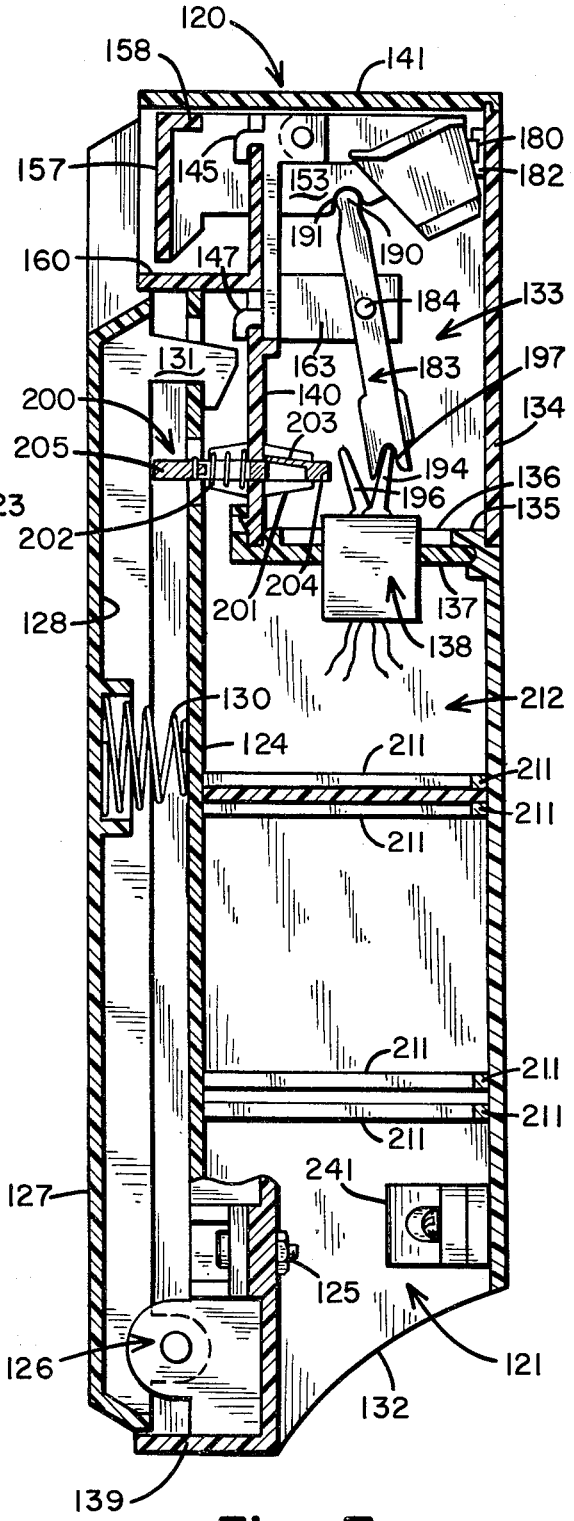
FIG. 7 is a view in longtidual section along the line 7-1 of FIG. 5 and looking in the direction of the arrows.

A rectangular protective chute 160 is positioned centrally at the top of the housing just beneath and flush with the top edge of the shroud. FIG. 7 shows a portion of that chute housing the face 157 of a push-button member 152, recessed against accidental actuation.

Actuating panel member 127, tapered on all sides and around the rectangular interruption along the top of the panel to accommodate the the chute 160, can move freely inward from its rest position without binding. The shroud effectively minimizes any rear or lateral force against actuating panel 127. On the right side of trough 121, but only partially shown and designated as 177, is the face of a shuttered anti-dust tumbler lock.

Figure 6:
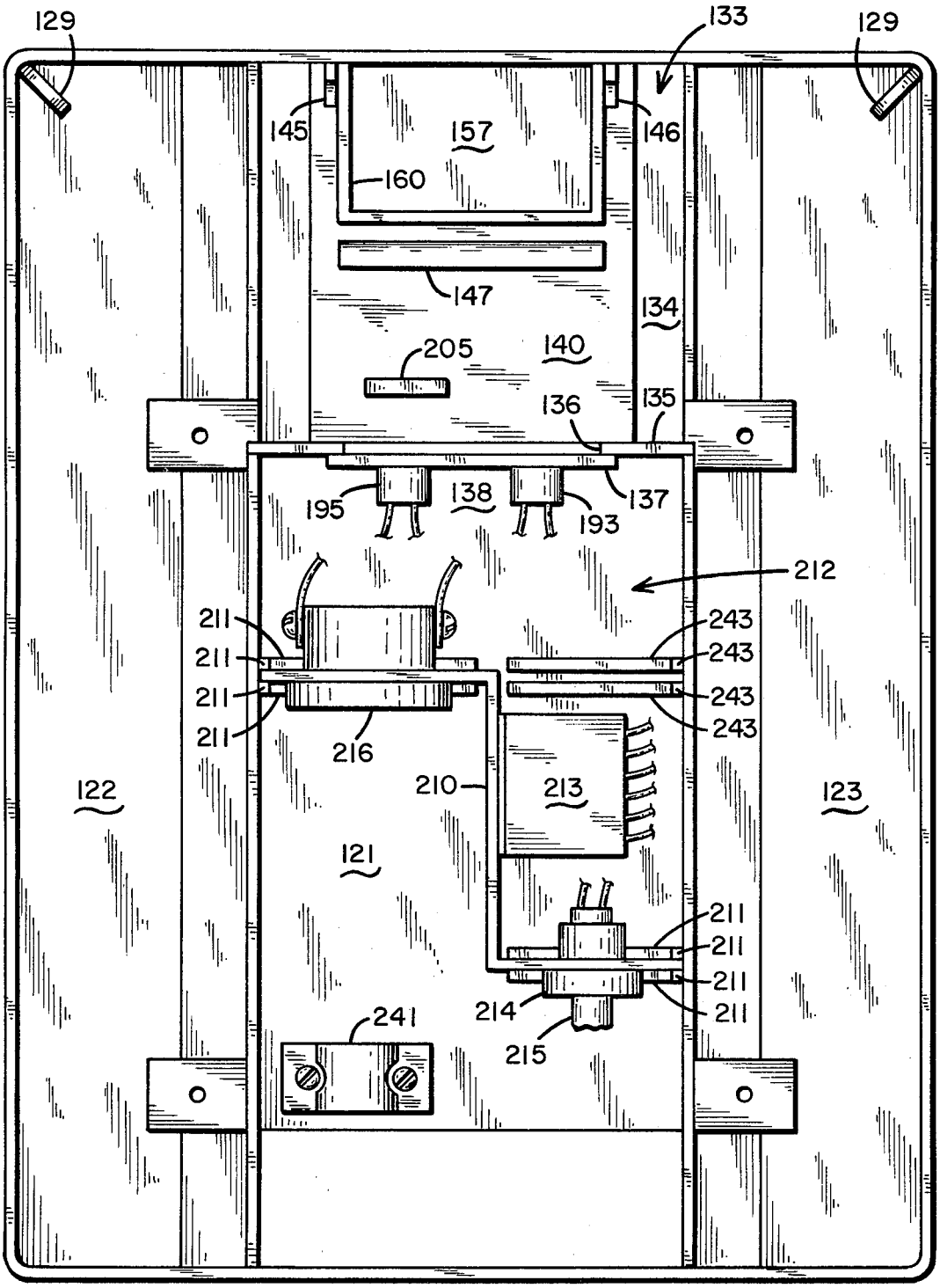
FIG. 6 is a front view of the structure of FIG. 5 with a cover removed.

FIG. 6 shows the housing 120 full-front, the integral continuity of the protective shroud and housing, and the principal elements and compartments of the deeper central through 121. There are two main compartments or chambers, an upper actuating chamber 133, and a central electrical wiring chamber 212. Separating these two chambers is a horizontal dividing wall 135, with an opening 136. Through this opening, two types of electrical switches, pre-positioned during manufacture in respect to switch plates to align with co-ordinating parts described below, may be emplaced so that the actuating levers or toggles are in the actuating chamber 133, and their wire-leads or terminal sides are in the wiring chamber 212.

Shown in FIG. 6, their wire-leads extending into chamber 212, are two momentary switches, one normally open, 193, and the other normally closed, 195; these two momentary switches comprise switch means identified by reference 138, and are mounted on a switch plate 137.

In connection with the momentary switches shown in FIG. 6 is also shown the removable "Z" shaped electrical wiring chamber partition 210. This "Z" shaped partition, slips in between the guides 211 at the right and left sides, and carries a receptacle 216, a relay 213, and a supply cord 215 and its strain-relief 214.

In the lower left corner of trough 121, in line with receptacle 216, a cord retainer 241 is positioned to clamp over the cord attached to whatever is plugged into receptacle 216. This arrangement eliminates any customer wiring, and cord retainer 241 is so placed that when the device is plugged in and the actuating member 127 and cover plate 124 are fastened into place, see FIGS. 5 and 7, access to remove the plug from receptacle 216 is eliminated unless the device is disassembled. Thus the locking system in the actuating chamber is validated.

FIG. 7, a vertical section of the switch actuating mechanism, shows the open faces of housing 120 and central trough 121 and how cover plate 124 for trough 121 is secured to the housing by fasteners 125. Pivotally secured, in turn, to cover plate 124, as by hinges 126, is the broad-surface actuating member 127, having a ribbed inner surface 128. A compression spring 130 acts between member 127 and cover plate 124, and catches 131 limit the movement of member 127 to a generally parallel alignment with plate 124, said latches 131 passing through appropriate slots in plate 124 and engaging the rear sides thereof. A pair of stops 129, FIG. 6, limit the inward movement of member 127.

Shown directly beneath the latch 131, a plunger assembly 200, sliding in guideway 201 and passing through vertical wall 140, also passes through cover plate 124. The plunger is normally urged outward by a compression spring 202, and its outward travel is limited by the rear stop 203. The inner end 204 of plunger 200 is in line with the switch lever 196, while the outer end 205 extends almost to a rib 128 of the broad-surface member, 127; the "OFF" mode train of parts is now complete. Removable speed 134 gives rear access to chamber 133.

The bottom end 132 of trough 121 is open to give access for supply cord 214 and for the plug and cord, or other wiring, of whatever is to be controlled by the device.

Figure 9:
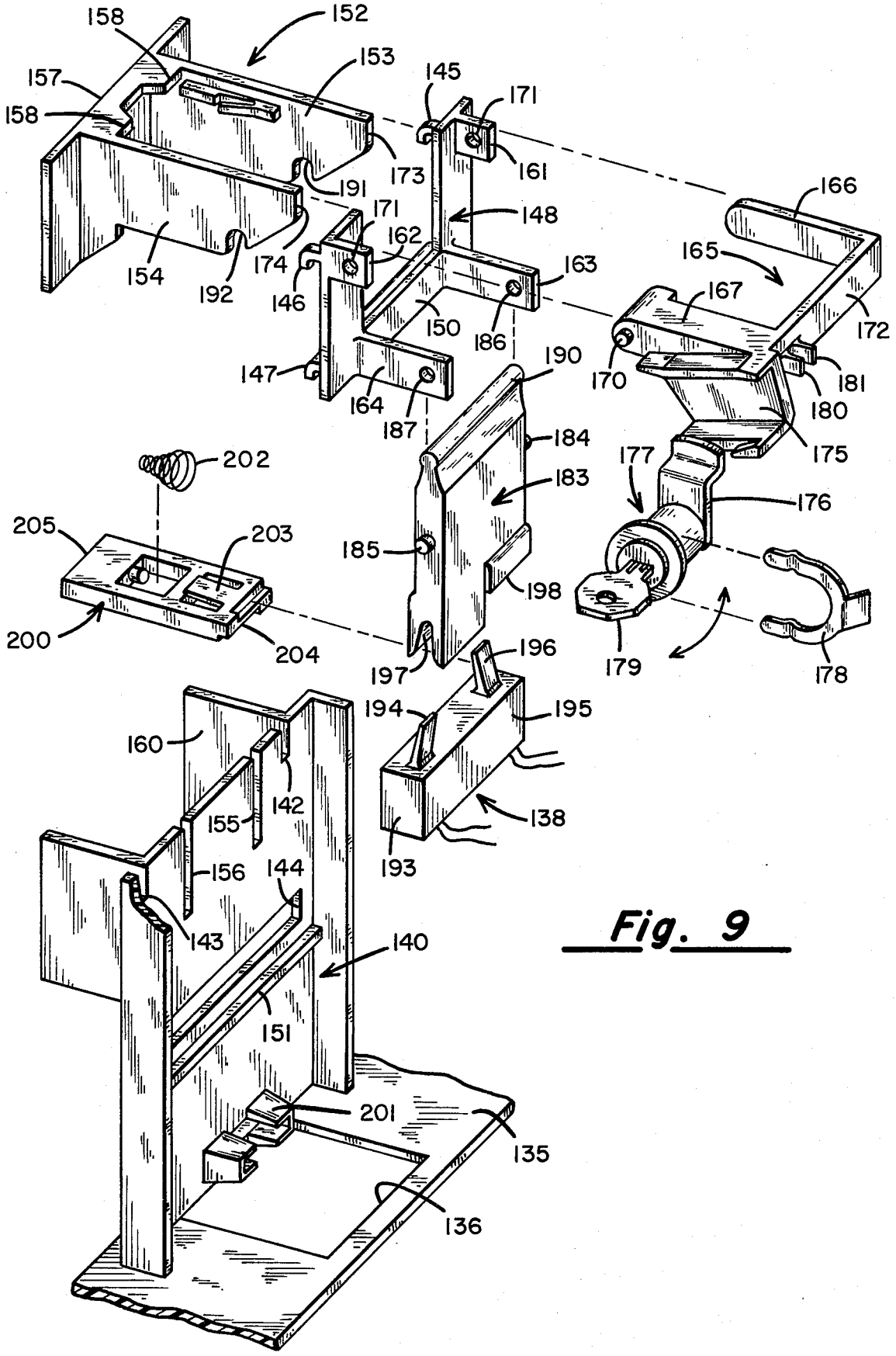
FIG. 9 is an exploded view of portion of the appartus.

FIG. 7 shows the elements of the mechanism in chamber 133, and the exploded isometric drawing of FIG. 9 affords a clearer depiction of parts. In FIG. 9 the vertical wall 140 at the front of chamber 133 has a pair of short vertical slots 142, 143 and a horizontal slot 144 to receive hooks 145, 146, and 147 respectively of a bearing-hanger-device 148, the bottom edge 150 of which rests on a ledge 151 of wall 140. Push-button member 152 has a pair of arms 153, 154 which ride in longer slots 155, 156 in wall 140. The flat button surface 157 of push-button member 152 moves in the protective chute 160 projecting from wall 140 and covered over the top by a portion of the shroud so that accidental contact with surface 157 is prevented. A pair of shoulders 158 project inward for arms 153, 154 to engage the front surface of wall 140 and limit the rearward movement of member 152.

Projecting rearward from device 148 are an upper pair of short ears 161, 162 and a lower pair of longer ears 163, 164. A "U" shaped stop member 165 has arms 166, 167 with pivot pins 170 which are received in pivot holes 171 in ears 161, 162. In a first, locking position of stop member 165, a cross bar 172 join arms 166, 167 pivots into engagement with ends 173, 174 of push-button arms 153, 154, preventing push-button 157 from being depressed. Stop member 165 has a cam follower 175 attached to arm 167 to receive a camming arm 176 from tumbler-lock 177. This lock is mounted in a wall of trough 121 by a spring-clip 178. When key 179 is turned counter-clockwise, cam 176 moves upward in cam-follower 175 and brings the stop member 165 with cross-bar 172 to a horizontal position as a barrier to push-button arms 153, 154.

A pair of fingers, 180, 181 extend from cross-bar 172 and span a diamond-shaped guide member 182 molded on the inner surface of removable panel 134. These spanning fingers spread over the widest point of the diamond-shaped guide, and in the locked position of stop member 165 they stabilize the stop member.

A rocker-arm 183 has a pair of central pivots 184, 185 which are received in pivot holes 186, 187 in ears 163, 164. The upper edge 190 of rocker-arm 183 has a cylindrical configuration to be received in notches 191, 192 formed in the lower rear edges of arms 153, 154 of push-button 152. Rocker arm 183 has a lower edge bifurcated at 197 to receive switch lever 194, which normally extends rearwardly, and a similar but somewhat higher bifurcation 198 to clear switch lever 196, and having a purpose presently to be described. Switch lever 196 is in line with plunger 200 and normally extends forward.

Figure 10:
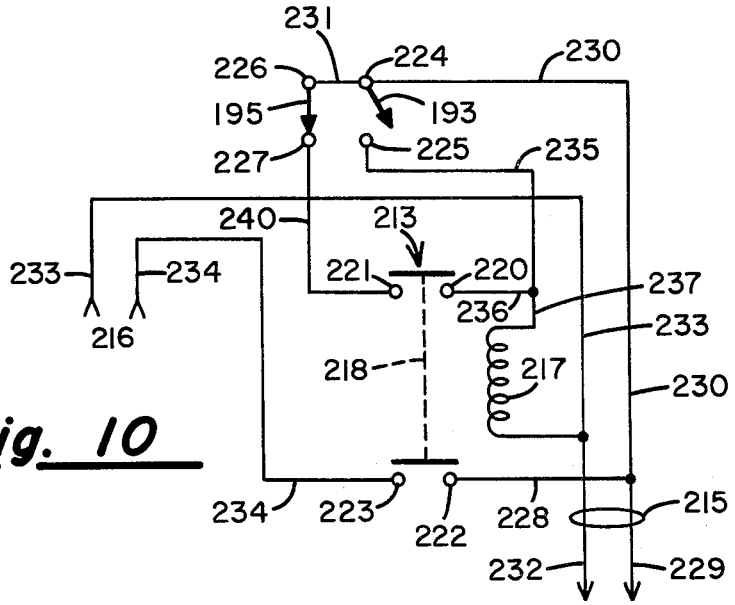
FIG. 10 is a wiring diagram of the second embodiment of the invention.

The interconnections for these components are shown in the wiring diagram of FIG. 10. Relay 213 is shown to have a winding 217 which may be energized to actuate an armature 218 to complete a first circuit between contacts 220 and 221 and to complete a second circuit between contacts 222 and 223. Switch 193 is shown to have a movable contact 224 and a fixed contact 225, and switch 195 is shown to have a movable contact 226 and a fixed contact 227. A circuit may be traced from one input conductor 229 through conductors 230 and 231 to the switch contacts 224 and 226, and through conductor 228 to relay contact 222. A circuit may be traced from the other input conductor 232 to one terminal of relay winding 217, and is continued through conductor 233 to one terminal of receptacle 216, the other terminal of which is connected by conductor 234 to relay contact 223. Conductors 235 and 236 connect switch contact 225 to relay contact 220, and the circuit is continued by conductor 237 to the second relay winding terminal. Switch contact 227 is connected by conductor 240 to relay contact 221.

Figure 11:
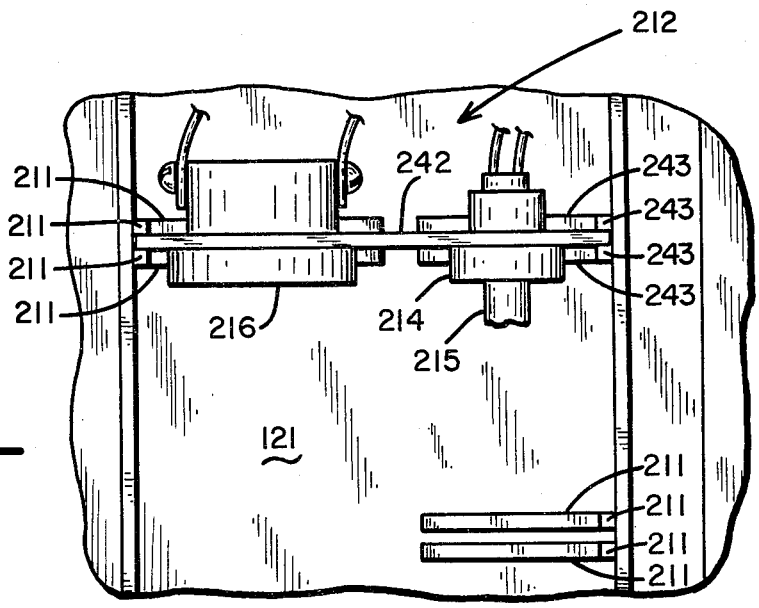
FIG. 11 is a fragmentary view showing a further embodiment of the invention.

It may be desired to omit the relay control of any device wired to the switch actuating mechanism and use instead direct switching control. FIG. 11 shows that a straight removable partition 242 may be plugged in between the upper guides 211 and symmetrically disposed guides 243, rather than using the "Z" shaped partition 210 as shown in FIG. 6. Mounted on partition 242 are receptacle 216, supply cord 215, and its attaching strain-relief 214. If direct switching is used, a single-pole, single-throw maintained "ON/OFF" switch is employed in an alternate switch plate, so that bifurcation 198 in rocker arm 183 engages the switch lever to turn the switch on. In this embodiment, the switch lever is again in line with the "OFF" plunger 200, and pressure applied to panel 127 is transmitted through the "OFF" plunger directly to the switch lever, which restores the switch lever to the "OFF" position and simultaneously repositions rocker arm 183 and push-button member 152.

Under some conditions it may be desired to permanently wire the switch actuating mechanism directly to existing relays or magnetic starters already at the site of installation. If this method is used, partition 242 with the receptacle and cord factory-attached is replaced by a partition equipped only with two knockouts for on-site wiring.

OPERATION OF THE SECOND EMBODIMENT

In operation, the apparatus is mounted convenient to the operator in his normal and natural position of operation. Members 127 and 124 are removed, the plug of any device to be controlled is inserted into receptacle 216 through the open end of trough 221, and the cord is secured in cord retainer 241, after which members 124 and 127 are replaced. Cord 215 is connected to a suitable source of electrical energy.

Figure 8:
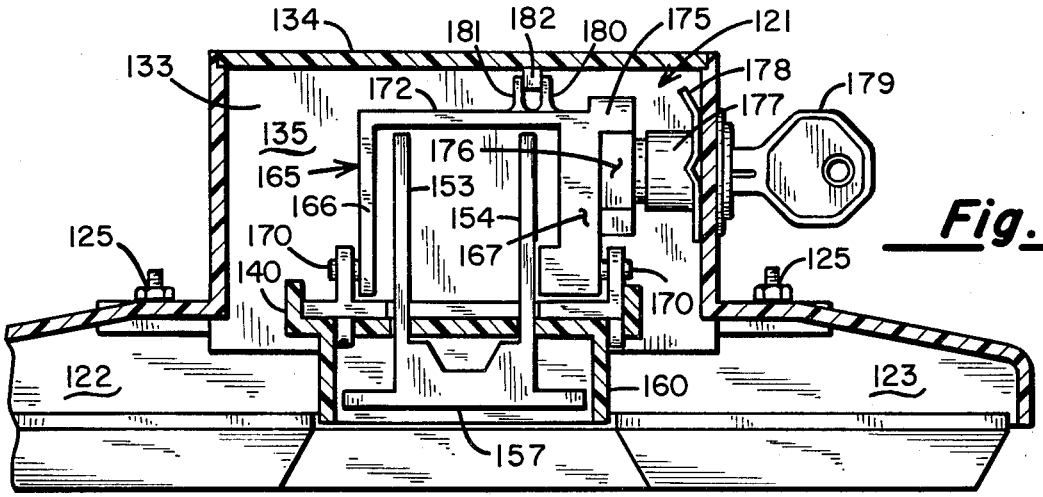
FIG. 8 is a fragmentary view in section along the line 8—8 of FIG. 5.

Consider first the embodiment shown in FIGS. 7–10. In FIG. 8, stop-member 165 prevents push-button member 152 from being depressed, by engagement of crossbar 172 with the ends of arms 153 and 154. In FIG. 7, rocker arm 183 is pivoted to a position in which end 190 is forward and bifurcation 197 is rearward, to agree with the normal "OFF" position of switch lever 194. Switch lever 196 is spring-urged into its forward normal or "ON" position. Because actuation to "ON" for momentary switch 193 by push-button member 152 has been locked out, as described above, the power circuit contacts to energize any device are open and no current can pass. Broad-surface member 127 may be depressed to act upon plunger 200 and press switch lever 196 to "OFF", but power circuit contacts as mentioned above are open, and no change occurs. It is evident that with the "ON" mechanism in a locked position, there can be no inadvertent starting of any device.

When it is desired to start the device, key 179 is used to unlock lock 177 and rotate camming arm 176 clockwise in cam-follower 175 to rotate stop-member 165 about pivots 170 until the crossbar 172 drops below the ends of arms 153 and 154. This of itself is not enough to energize the circuit, but it enables push-button member 152 to be depressed, and notches 191 and 192 acting on end 190 of rocker arm 183 move it rearward so that bifurcation 197 acting upon switch lever 194 can momentarily close switch 193 to energize the relay, which completes its holding circuit and closes the power circuit contacts and thus turns the device "ON".

The slanted profile of the lateral tray portion 123 of the shroud at its exterior rear surface effectively precludes an obstruction such as a key ring or the like from being jammed and blocking the rearward movement of the broad-surface member.

At any time when it is desired to de-energize the device, simple rearward pressure almost anywhere against the broad-surface member 127 is sufficient to move plunger assembly 200 so that its inner end 201 travels the distance necessary to engage lever 196 and move that lever rearward far enough to open switch 195. This breaks the relay holding circuit described above and the device is consequently shut off. When the pressure on member 127 is released, the plunger assembly returns to its forward rest and the spring-urged lever 196 also returns to a forward position. There is no danger of over-ride in the pressure applied to 127 because the stops 129 in the shroud halt member 127 before any damage can be done to switch lever 196.

If the embodiment of FIG. 11 is used, a single-pole, single-throw maintained "ON/OFF" toggle switch is employed. In this embodiment, push-button 157 must again be unlocked so that rocker arm 183 can actuate the switch lever, captured in bifurcation 198, forward or "ON". The switch, rocker arm and push-button member remain in the "ON" or operative position. There is no holding circuit involved. To turn this embodiment to "OFF", member 127 must be depressed as before, and the plunger assembly 200 again engages the switch lever to move it rearward to the "OFF" position, restoring the rocker arm and the push-button to their initial positions. Release of pressure upon 127 again allows plunger 200 to return to its forward, normal position.

The invention has been described herein in considerable detail, in order to comply with the patent statutes and to provide those skilled in the art with information needed to apply the novel principles thereof. However, it is to be understood that the invention can be carried out by specifically different equipment and devices, and that various modifications, both as to equipment details and operating procedures, can be effected without departing from the scope of the invention itself.

What is claimed is:

1. A switch actuating mechanism to be used with electrical motor driven apparatus for facilitating the energization and deenergization thereof, comprising, in combination:

(a) an electrical junction box for containing an electrical switch to be actuated, said electrical switch having at least one operating lever extending through a top surface of said box;

(b) a broad surface member of a predetermined length and width dimension pivotally coupled to said junction box;

(c) a housing affixed to said top surface of said electrical junction box having mating mutually perpendicular top, front and side walls, said front wall being of a height less than said side walls to define an opening;

(d) a push button member of a relatively small size compared to said broad surface member mounted for reciprocal movement within said opening of said housing;

(e) means coupling said push button member to said operating lever for moving said lever to an "on" position when said push button member is depressed; and (f) means coupling said broad surface member to said switch operating lever for moving said lever to an "off" position when said broad surface member is depressed.

2. The switch actuating mechanism as in claim 1 and further including:

(a) key operated lock means mounted on said housing, said lock means including means for preventing depression of said push button member when said lock means is in a locked condition.

3. Apparatus as in claim 2 wherein said key operated lock means comprises:

(a) a key receiving tumbler assembly;

(b) a cam secured to said tumbler assembly and rotatable only when a proper key is inserted in said key receiving tumbler assembly; and (c) a cam follower mounted within said housing and operatively connected to said cam for movement between first and second positions when said key is turned in said tumbler assembly, said first position being disposed in a path of travel of said push button member and said second position being out of said path of travel of said push button.

4. The switch actuating mechanism of claim 1 wherein said broad surface member has a rectangular opening formed proximate the center of the upper edge thereof, said rectangular opening being in alignment with said rectangular opening of said housing.

5. The switch actuating mechanism of claim 1 wherein said means coupling said broad surface member to said switch operating lever comprises:

(a) a spring-loaded plunger means having first and second ends, said plunger means mounted in said front wall of said housing and having one of said first and second ends of said plunger means in alignment with said switch operating lever and another of said first and second ends of said plunger means disposed adjacent to said broad surface member.

6. The switch actuating mechanism as in claim 1 wherein said means coupling said push button member to said operating lever comprises:

(a) a rocker arm having first and second ends and a pivot support therebetween, said rocker arm being pivotally supported within said housing and having one of said first and second ends below said pivot support for engaging said switch operating lever; and (b) guide rib means affixed to said push button member and extending through slot means formed in said front wall of said housing, said guide rib means coupled to the other of said first and second ends of said rocker arm above said pivot support.

7. The switch actuating mechanism as in claim 1 wherein said electrical junction box comprises:

(a) integrally formed side, rear, top and bottom panel members, said side and rear panel members being of a predetermined length, said side members having outwardly extending flanges along one side edge thereof;

(b) a generally U-shaped channel member having a rectangular base portion and side walls extending perpendicularly therefrom, said channel member having upper and lower generally parallel edges and being of a length substantially greater than said predetermined length; and (c) means attaching said flanges to said base portion of said channel member whereby said base portion of said channel member forms the front face of said junction box, said broad surface member being pivotally attached to said side walls of said channel member at a location proximate said lower edge of said channel member.

8. Apparatus as in claim 7 and further including a compression coil spring disposed between said broad surface member and said base portion of said channel member to normally urge them apart from one another.

9. The switch actuating mechanism as in claim 1 wherein said electrical switch includes a further operating lever, said one operating lever being coupled to said push button member and said further operating lever being coupled to said broad surface member.

10. The switch actuating mechanism as in claim 9 and further including a spring-loaded plunger disposed in said front wall of said housing, said plunger being aligned with said further of said operating levers, and actuated by a force applied to said broad surface member.

11. Switching apparatus for use in connecting an electric load to a source of electrical energy to facilitate the energization and de-energization of said load, comprising, in combination:

(a) a housing having an open face and comprising a central deeper trough open at one end and a closed other end and lateral shallower trays;

(b) an actuation chamber at the closed other end of said trough;

(c) removable partition means defining in said housing a connection chamber between said actuation chamber and said open end;

(d) switch means in said connection chamber adapted to couple said load and to said source of electrical energy, said switch means including lever means for causing operation thereof extending into said actuation chamber;

(e) a cover for said trough secured to said housing and apposed in front of said open face, said cover having a rectangular opening;

(f) a broad-surface actuating member supported by said cover for pivotal movement outside said cover about an axis parallel to said broad surface;

(g) a push-button means of relatively small size comparred to said actuating member;

(h) means mounting said push-button means for reciprocating motion within said rectangular opening in a direction orthogonal to said axis;

(i) means carried by said removable partition means for enabling connection of said switch means to said source and said load;

(j) means in said actuation chamber coupling said push-button means to said lever means to cause said switch means to complete an energizing circuit for said load when said push-button means is depressed; and (k) means connecting said broad-surface actuating member to said lever means to cause said switch means to interrupt said energizing circuit when said broad surface actuating member is depressed.

12. Apparatus according to claim 11 and further comprising key actuated means projecting into said actuation chamber for locking said first linkage means to prevent operation of said push-button member.

13. Apparatus according to claim 11 in which the said broad-surface actuating member is circumscribed by said housing so that it can be contacted substantially at only said outer face thereof.

14. Apparatus according to claim 11 in which said partition means mounts a connecting cord, a relay, and a receptacle.

15. Apparatus according to claim 11 in which said partition means mounts a connecting cord and a receptacle.

16. Apparatus according to claim 11 in which said partition means mounts a plurality of knockouts.

17. Switching apparatus for use with an electric motor to facilitate the connection and disconnection of said motor to a source of electrical energy thereof, comprising, in combination:

(a) a housing having an open face and comprising a central trough having one open end and one closed end;

(b) an actuation chamber at said closed end of said trough;

(c) partition means defining in said trough a connection chamber between said actuation chamber and said one open end;

(d) switch means in said connection chamber for connection of said motor to said source of electrical energy, said switch means including lever means for causing operating thereof extending into said actuation chamber;

(e) a cover for said trough secured to said housing, and having a rectangular opening;

(f) a broad-surface actuating member supported by said cover for pivotal movement about an axis parallel to said broad surface and having an outer face; and (g) switch actuating means in said actuation chamber including a push-button member of relatively small size compared to said broad-surface actuating member, means mounting said push-button member for reciprocating motion in said actuation chamber through said rectangular opening, in a direction orthogonal to said axis first linkage means in said actuation chamber coupling said push-button member to said lever means for operating said switch means when said push-button means is depressed, and second linkage means in said actuation chamber coupling said broad-surface actuating member to said lever means to operate said switch means when said broad surface means is depressed.

* * * * *